US006988554B2

(12) United States Patent
Bodine et al.

(10) Patent No.: US 6,988,554 B2
(45) Date of Patent: Jan. 24, 2006

(54) SUBSEA CHOKE CONTROL SYSTEM

(75) Inventors: John Eric Bodine, Houston, TX (US); David Anthony James, Houston, TX (US); Declan Elliott, Lamagh (IE)

(73) Assignee: Cooper Cameron Corporation, Houston, TX (US)

( * ) Notice: Subject to any disclaimer, the term of this patent is extended or adjusted under 35 U.S.C. 154(b) by 53 days.

(21) Appl. No.: 10/427,368

(22) Filed: May 1, 2003

(65) Prior Publication Data

US 2004/0216884 A1 Nov. 4, 2004

(51) Int. Cl.
*E21B 34/00* (2006.01)

(52) U.S. Cl. ..... 166/363; 166/66.6

(58) Field of Classification Search ..... 166/363, 166/336, 366, 344, 339, 311, 66.6, 362
See application file for complete search history.

(56) References Cited

U.S. PATENT DOCUMENTS

| | | | | |
|---|---|---|---|---|
| 4,174,000 A | | 11/1979 | Milberger | 166/362 |
| 4,234,043 A | | 11/1980 | Roberts | 166/336 |
| 4,337,829 A | | 7/1982 | Banzoli et al. | 166/366 |
| 4,636,934 A | | 1/1987 | Schwendemann et al. | 364/132 |
| 4,848,473 A | | 7/1989 | Lochte | 166/344 |
| 4,899,822 A | | 2/1990 | Daeschler et al. | 166/339 |
| 5,010,956 A | | 4/1991 | Bednar | 166/344 |
| 5,025,865 A | | 6/1991 | Caldwell et al. | 166/366 |
| 5,295,547 A | | 3/1994 | Coelho et al. | 166/368 |
| 6,105,367 A | * | 8/2000 | Tsuruga et al. | 60/422 |
| 6,192,681 B1 | * | 2/2001 | Tsuruga et al. | 60/447 |
| 6,286,602 B1 | | 9/2001 | Lemetayer et al. | 166/311 |
| 6,637,522 B2 | * | 10/2003 | Wilson et al. | 175/25 |
| 2002/0040789 A1 | | 4/2002 | Davey et al. | |
| 2002/0100589 A1 | | 8/2002 | Childers et al. | 166/339 |

FOREIGN PATENT DOCUMENTS

| | | |
|---|---|---|
| WO | WO 00/01915 A3 | 1/2000 |
| WO | WO 00/01915 | 1/2000 |
| WO | WO 99/47788 | 9/2003 |

OTHER PUBLICATIONS

Combined Search and Examination Report for British Application No. GB0409520.4 dated Sep. 16, 2004;(pp.6).

* cited by examiner

*Primary Examiner*—Frank Tsay
(74) *Attorney, Agent, or Firm*—Conley Rose, P.C.

(57) ABSTRACT

A choke actuator having an integrated choke control system enabling fast closure and opening of the choke. The choke control system includes integral electronics to receive signals from a surface or subsea control module and control directional control valves to regulate the flow of hydraulic fluid from a local hydraulic supply to the choke actuator. Response times for choke actuation are greatly reduced by locating the electronic control system and directional control valves in an integrated package with the choke actuator and providing a local hydraulic supply. Additional embodiments may also include other electronic sensing and instrumentation enabling the choke control system to monitor and adjust the choke to maintain selected flow characteristics or in accordance with a predetermined production scheme. Any or all of the components of the choke, the choke control system, or the choke actuator may also be retrievable separately from the other components so as to allow maintenance and replacement.

22 Claims, 7 Drawing Sheets

100
120
122
110
16
82
70
80
54
52
40
60
20
30

SUBSEA CHOKE CONTROL SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The embodiments of the present invention relate generally to methods and apparatus for subsea control systems. More particularly, the embodiments of the present invention relate to control systems for subsea chokes. More particularly, the embodiments of the present invention relate to control systems for improving the response time, controllability, uptime availability, and retrievability of the active components of subsea chokes.

In offshore oil and gas production, it is often common for more than one well to be produced through a single flowline. In a typical installation, the products from each individual well flow are combined into a common flowline, which then carries the products to the surface or combines those products with the products of other flowlines. The difficulty in managing a multiple well completion produced through a single flowline is that not all of the wells may be producing at the same pressure conditions or include the same flow constituents (liquids and gases).

For example, if one individual well is producing at a lower pressure than the pressure maintained in the flowline, fluid can backflow from the flowline into that well. Not only is the loss of production fluids undesirable, but the pressure changes and reverse flow conditions within that well may damage the well and/or reservoir. Similarly, if one well is producing at a pressure above the flowline pressure, that well may produce at an undesirable flow rate and pressure, again with the potential to damage other wells and/or the reservoir. Thus, the management of flow rates and pressures is of critical importance in maximizing the production of hydrocarbons from the reservoir.

Prior art subsea production systems, including a choke 15, are shown in FIGS. 1–3. Referring initially to FIG. 1, control signals and a hydraulic fluid supply are transmitted along an umbilical 30 from a topside control system 20 to a subsea control module 40, which supplies hydraulic fluid to actuators in the subsea trees, manifolds, valves, and other functions along lines 60. As control valves within the control module 40 receive signals to open or close the choke, the control valves actuate to control the flow of hydraulic fluid to the choke actuator 17 through either hydraulic line 16, for opening, or hydraulic line 18, for closing. The common choke actuator 17 is a hydraulic stepping actuator, which, depending on the style of actuator and choke being used, may take 100 to 200 steps to close, although systems requiring a smaller, or larger, number of steps are possible. Each step involves the actuator 17 receiving a pulse of hydraulic pressure, which moves the actuator, and then a release of that pressure, which allows a spring to return the actuator to its initial position. In typical systems, where the SCM is located proximate (e.g., within about 30-feet) to the choke/actuator, about one second is required for the pressure pulse to travel from the control valve in module 40 to the actuator 17 and two seconds are required for the spring to return the actuator to its initial position. Thus, with a total of three seconds per step and a total of up to 200 or more steps required to fully actuate the choke, the time required to fully close or open the choke is considerable. The risk of equipment failure is also increased due to the components being actuated hundreds, thousands, or even millions, of times.

Another typical prior art subsea production system, including a choke 15, is shown in FIG. 2. Control signals and a hydraulic fluid supply are transmitted along an umbilical 32 from a topside control system 20 directly to a subsea choke 15, bypassing subsea control module 40 on an electro hydraulic control system. Operation of a direct hydraulic control system would also be as described above, since no subsea control module is required, and a direct electric (control) system would operate similarly, minus any hydraulic control lines. The choke 15 is opened and also closed via hydraulic signals transmitted through dedicated umbilical lines. Hydraulic signals from the surface control the flow of hydraulic fluid to the choke actuator 17 through either hydraulic line 16, for opening, or hydraulic line 18, for closing. The common choke actuator 17 is a hydraulic stepping actuator which, depending on the style of actuator and choke being used, may take 130–180 steps to close. Each step involves the actuator 17 receiving a pulse of hydraulic pressure, which moves the actuator, and then a release of that pressure, which allows a spring to return the actuator to its initial position. In typical systems, the time required for the pressure pulse to travel from the surface to the actuator 17 is directly related to the offset distance (umbilical length from surface to choke), water depth and actuating pressure, which can be minutes per step for long offsets. Also, an additional amount of time is required for the spring to return the actuator to its initial position. The time to actuate each step can run into minutes, thus, with a total of up to 180 steps required to fully actuate the choke, the time required to fully close or open the choke is considerable.

A third typical prior art subsea production system, including a choke 15, is shown in FIG. 3. Electrical power and a hydraulic fluid supply are transmitted along an umbilical 34 from a topside control system 20 directly to a subsea choke actuator system 22, bypassing subsea control module 40 on an electro hydraulic control system. Operation of a direct hydraulic control system would also be as described above, since no subsea control module is required, and a direct electric (control) system would operate similarly, minus any hydraulic control lines. A hydraulic fluid supply is stored local to the choke 15, such as in accumulator 28. The choke 15 is opened and also closed via electrical signals transmitted through dedicated umbilical conductors 26 and 27 to actuate the open and close functions. The electrical signals are received by a directional control valve 38 that regulates hydraulic flow to the open and close functions of choke actuator 17. For this instance, hydraulic fluid is supplied to the local choke accumulators 28, which are refilled by the hydraulic supply along umbilical 32. The common choke actuator 17 is a hydraulic stepping actuator which, depending on the style of actuator and choke being used, may take 100 to 200 steps to close. Each step involves the actuator 17 receiving an electrical power pulse, followed by a pulse of hydraulic pressure, which moves the actuator, and then a release of the electrical power that releases the hydraulic pressure, which allows a spring to return the actuator to its initial position. In typical systems, roughly one second is required for the electrical power pulse to travel from the surface to the choke, and then for the pressure pulse to travel from the local choke accumulator to the actuator 17 and roughly two seconds are required for the spring to return the actuator to its initial position. Thus, with a total of three to four seconds per step and a total of up to 180 steps required to fully actuate the choke, the time required to fully close or open the choke is considerable. The power requirements for this type of system are considerable, while the umbilical must have electrical conductors 26 and 28 (one for open, one for close) for each choke.

Thus, there remains a need in the art for methods and apparatus for increasing the responsiveness and speed of choke control systems, especially subsea systems. Therefore, the embodiments of the present invention are directed to methods and apparatus for controlling choke actuation that seek to overcome the limitations of the prior art.

SUMMARY OF THE PREFERRED EMBODIMENTS

The preferred embodiments provide a choke or choke actuator having an integrated control system enabling fast closure and opening of the choke. The control system includes integral electronics, such as a valve electronic module, controlling directional control valves and/or solenoid valves, which regulate the flow of hydraulic fluid from a local hydraulic supply to the choke actuator. By locating the control system, directional control valves, and hydraulic supply proximate to the choke actuator, response times for choke actuation are greatly reduced. Additional embodiments may also include other electronic sensing and instrumentation enabling the choke control system to monitor and adjust the choke to maintain selected flow characteristics or in accordance with a predetermined production scheme. Any or all of the components of the choke, the choke control system, or the choke actuator may also be retrievable separately from the other components so as to allow maintenance and replacement.

In certain embodiments, the choke control system includes one or more valve electronic modules that receive electric signals from the surface along a single, or dual redundant, control line(s). The valve electronic module processes these signals and transmits electrical signals to a directional control valve. The directional control valve includes solenoid valves that, upon receiving a signal from the valve electronic module, actuate to allow hydraulic fluid to flow between a supply and the choke actuator. In the preferred embodiments, the hydraulic supply is located proximate to the choke, such as in an accumulator, so as to minimize the reaction time of the hydraulic signal between the supply and the choke actuator. The choke control system and actuator are preferably integrated into a single package that can be retrieved to the surface for maintenance independent of the choke. Alternatively, the choke control system and actuator can be packaged for separate and/or singular retrieval.

Incorporating a valve electronic module into the choke control system allows for gains in efficiency in actuating the choke directly from a control system located at the surface, or in actuating the choke from a subsea control module receiving commands from a control system located at the surface. Communication to the choke control system could be provided by hydraulic and electric umbilicals run between the surface control system, or the subsea control module, and the choke control system. The hydraulic and electric signals would merely be commanded by the surface control system or passed along by the subsea control module to the choke control system. Once the electric signal is received by the choke control system, the valve electronic module processes the signal and actuates the directional control valve to open or close the choke as commanded.

In an alternative embodiment, the surface control system could be in direct electrical communication with the choke control system while hydraulic supply is still received via a main umbilical through the subsea control module and any proximate accumulators. This system allows direct electrical communication with the choke control system while taking advantage of the hydraulic supply provided by the main umbilical and any proximate accumulators. The commanded electrical signal transmitted along the dedicated umbilical to the choke control system is received and analyzed by the valve electronic module to adjust the choke as desired.

In certain embodiments, the valve electronic module could also provide the choke and choke control system with additional functionality. For example, the valve electronic module may be equipped to monitor pressure transmitters attached to the directional control valve to monitor the application of hydraulic pressure to the actuator. The electronic module may also operate in conjunction with a position measurement sensor to determine the actual position of the choke at any time. The electronic module could also be used to gather data from these and other sensors, such as pressure and/or temperature sensors on the choke inlet and outlet, and transmit this data back to the surface to give the operators an indication of flow conditions at the choke. For example, the use of a venturi, or other geometry change, in conjunction with additional pressure and temperature measurement transmitted to the subsea control module and/or to the surface could enable analytical measurement and determination of flow rates and flow constituency make-up parameters.

In the preferred embodiments, the improved choke control system allows for significantly increased stepping rates leading to decreased reaction time for choke actuation. Certain embodiments may also provide for increased data acquisition and analysis of flow condition at or near the choke, which could lead to indications of flow characterization and detection of the formation of hydrates.

Thus, the present invention comprises a combination of features and advantages that enable it to improve the responsiveness and performance of a subsea, or surface, choke control system. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
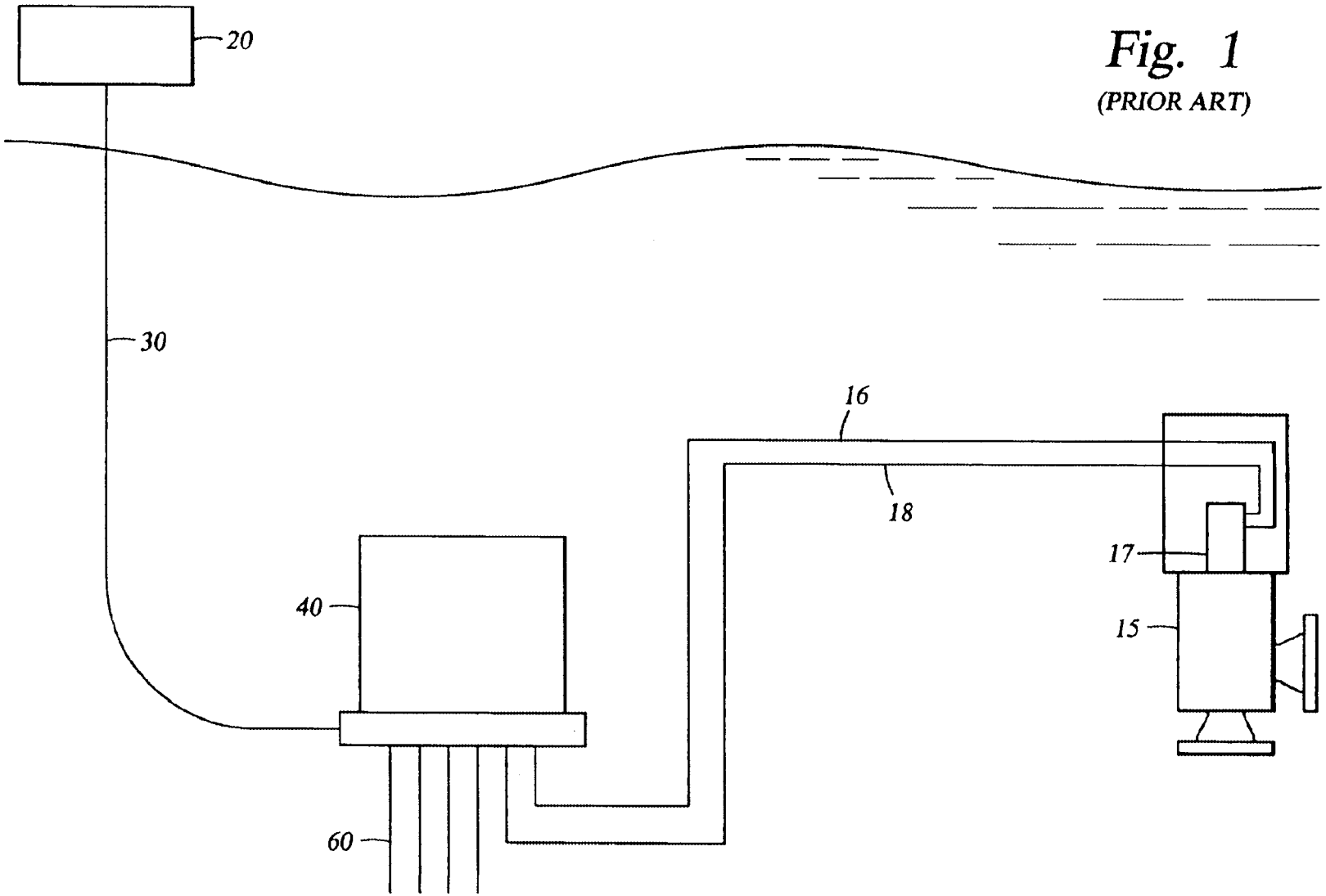
Fig. 1 (PRIOR ART)
FIG. 1 is a schematic view of a prior art subsea choke system having direct hydraulic control from a subsea control module.
Figure 2:
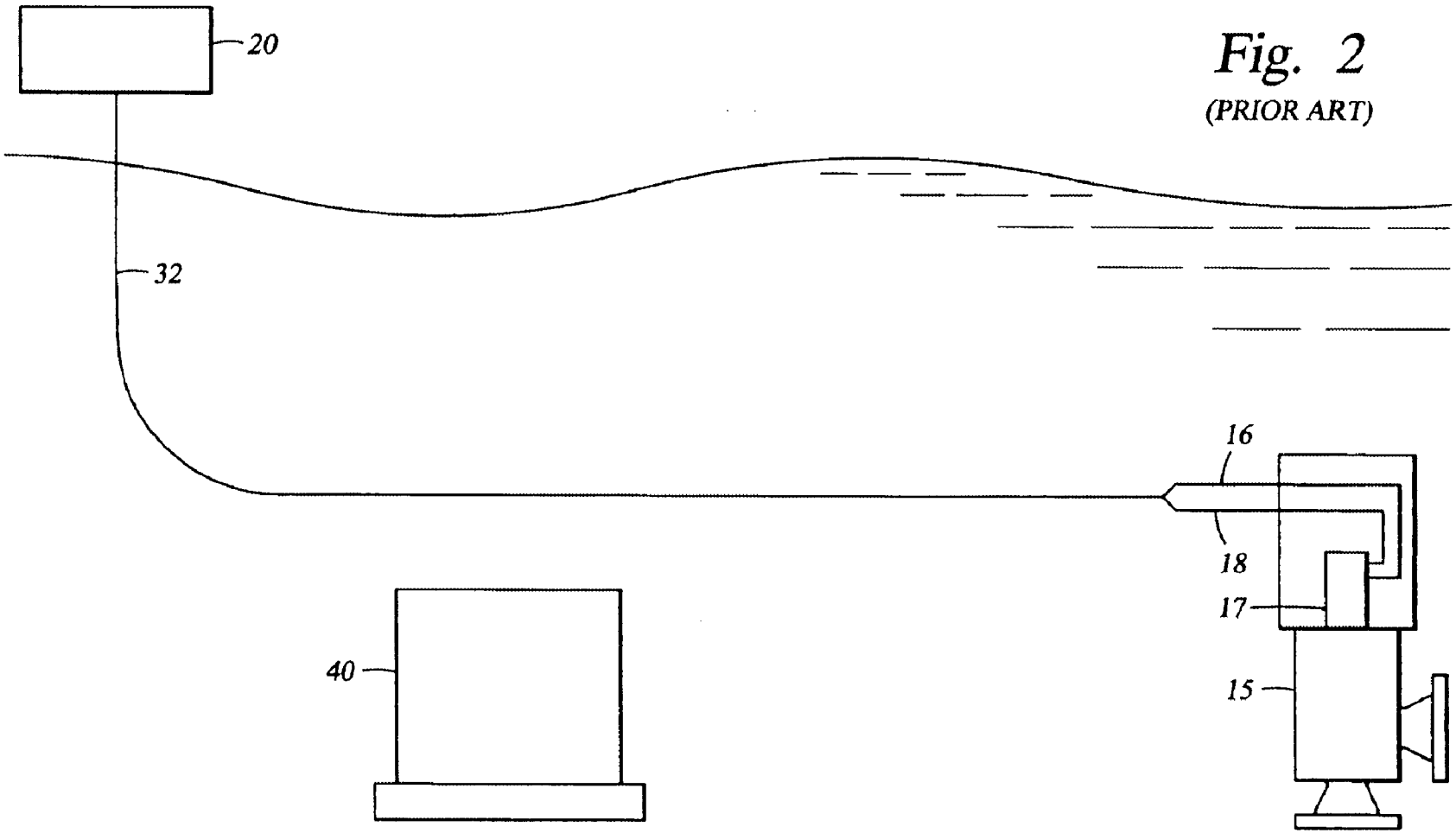
Fig. 2 (PRIOR ART)
FIG. 2 is a schematic view of a prior art subsea choke system having direct hydraulic control from a surface control system.
Figure 3:
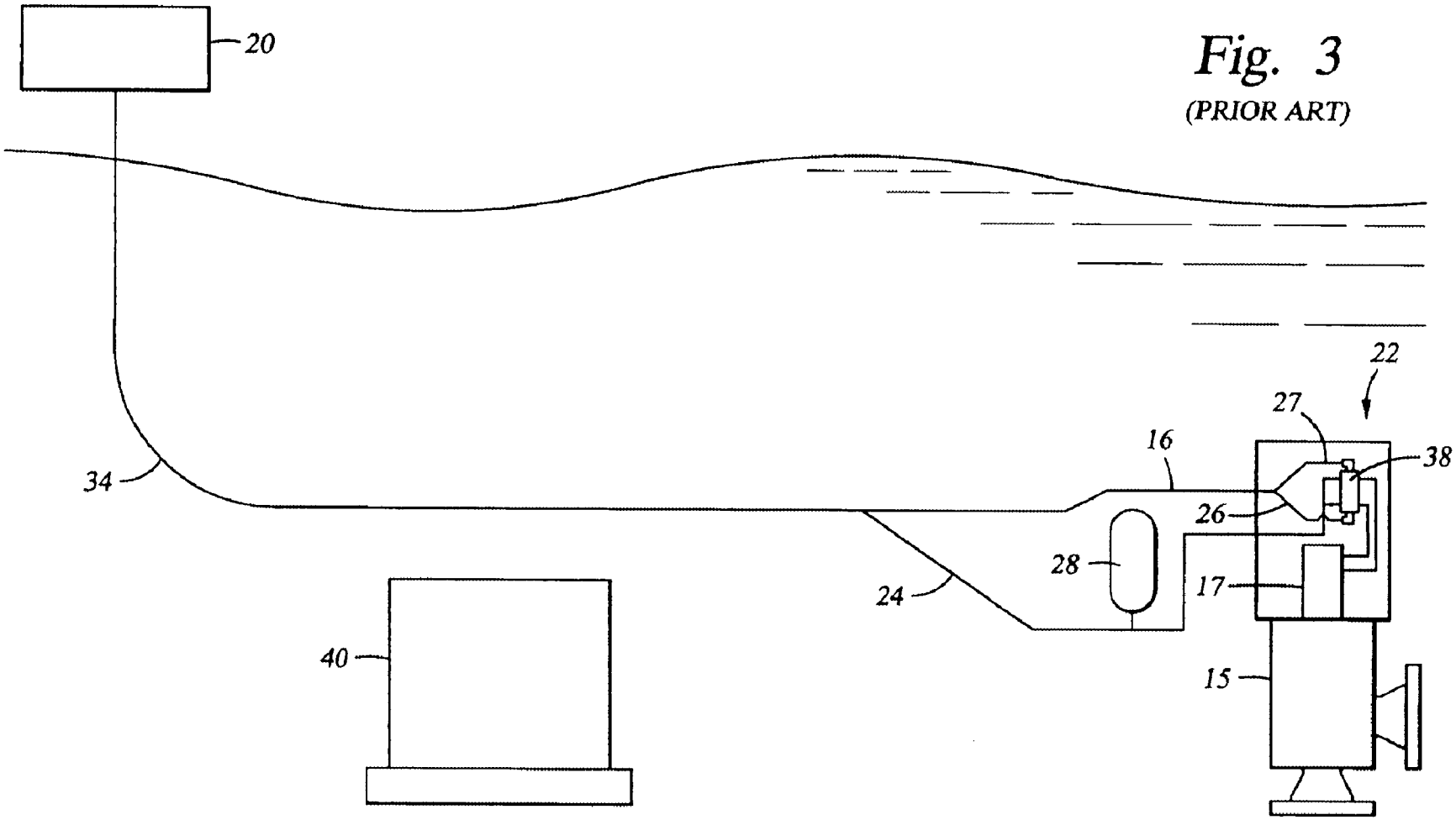
Fig. 3 (PRIOR ART)
FIG. 3 is a schematic view of a prior art subsea choke system having direct electric control from a surface control system.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

In particular, various embodiments of the present invention provide a number of different methods and apparatus for affecting control of a choke assembly. The concepts of the invention are discussed in the context of subsea choke assemblies but the use of the concepts of the present invention is not limited to subsea chokes specifically or choke assemblies generally. The concepts disclosed herein may find application in other choke assemblies, such as surface chokes, as well as other hydraulically actuated assemblies, both within oilfield technology and other high pressure, heavy duty applications to which the concepts of the current invention may be applied. Other embodiments of the control system may include any subsea adjustable components, for example: chokes, downhole or below the mudline/tubing hangers, control valves, etc.

In the context of the following description, the term "choke" is used to refer to the family of devices incorporating a fixed or variable orifice that is used to control fluid flow rate or downstream system pressure. These devices may also be known as pressure control valves (PCV). Chokes are available for both fixed and adjustable modes of operation and can be used for production, drilling, or injection applications. Adjustable chokes enable the fluid flow and pressure parameters to be changed to suit process or production requirements. Types of chokes may include, but are not limited to, flowline chokes (whether stepping type, or infinitely variable type); subsea or surface separator/processing unit chokes (upstream or downstream) that enable smooth flow into or out from the subsea or surface separator/processing unit; hydraulic submersible pump supply chokes; subsea or surface chemical injection "metering" chokes, etc.

Figure 4:
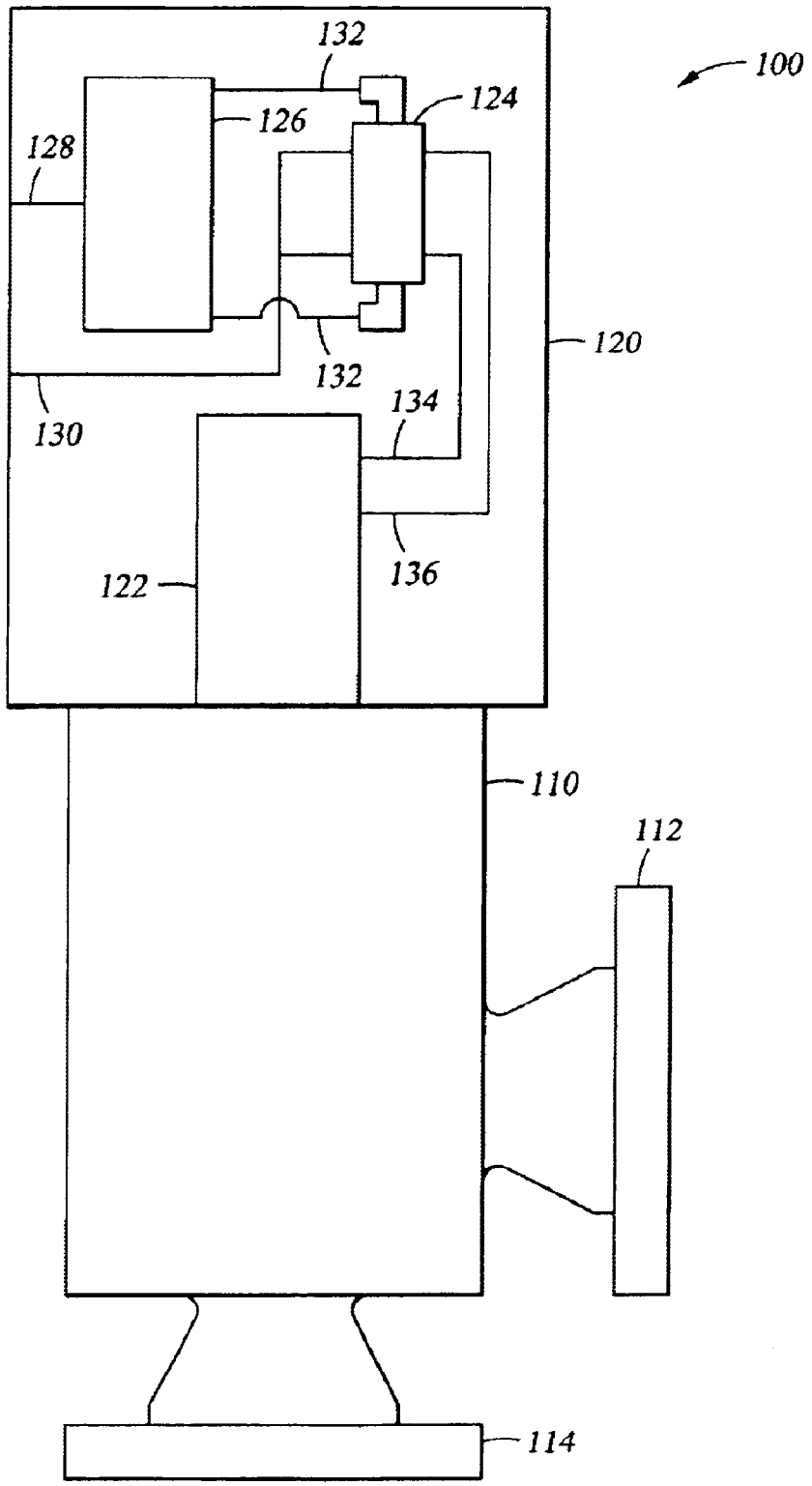
FIG. 4 is a schematic view of a choke control system with integral electronics.

FIG. 4 shows one embodiment of a subsea choke system 100 including a choke body 110 and a choke control system 120. Choke body 110 includes an inlet 112 and an outlet 114 and controls the flow of fluid from the inlet to the outlet by varying the position of an insert (not shown) that restricts the flow through the choke body. In certain embodiments, the choke control system 120 is detachable from the choke body 110 and can be retrieved to the surface along with, or independently from, the insert for maintenance and replacement.

Control system 120 includes a choke actuator 122, directional control valve 124, valve electronic module 126, signal input 128 (which may be digital, analog, optical, electrical, or any signal) ("signals,") and hydraulic input 130. The valve electronic module 126 receives signals from a surface control system via signal input 128. In response to the signals received, the valve electronic module 126 transmits signals through electrical connections 132 to the solenoid valves of directional control valve 124. A supply of hydraulic fluid is provided to the directional control valve 124 along hydraulic input 130. The actuation of the solenoid valves opens hydraulic pathways that allow a hydraulic signal to travel from the directional control valve 124 along hydraulic conduit 134 or 136 to the choke actuator 122.

The choke actuator 122 is preferably a hydraulic stepping actuator, of the type commonly used in choke actuation, which converts the linear motion from hydraulic actuation into rotational motion to open or close the choke insert. Hydraulic conduits 134 and 136 provide hydraulic fluid to either an open or close spring-return hydraulic cylinder. These cylinders move linearly in response to hydraulic pressure and then return to their initial positions using a biasing spring. Thus, each pressure pulse from the directional control valve 124 rotates the choke actuator a certain increment causing linear adjustment of the choke insert.

Figure 5:
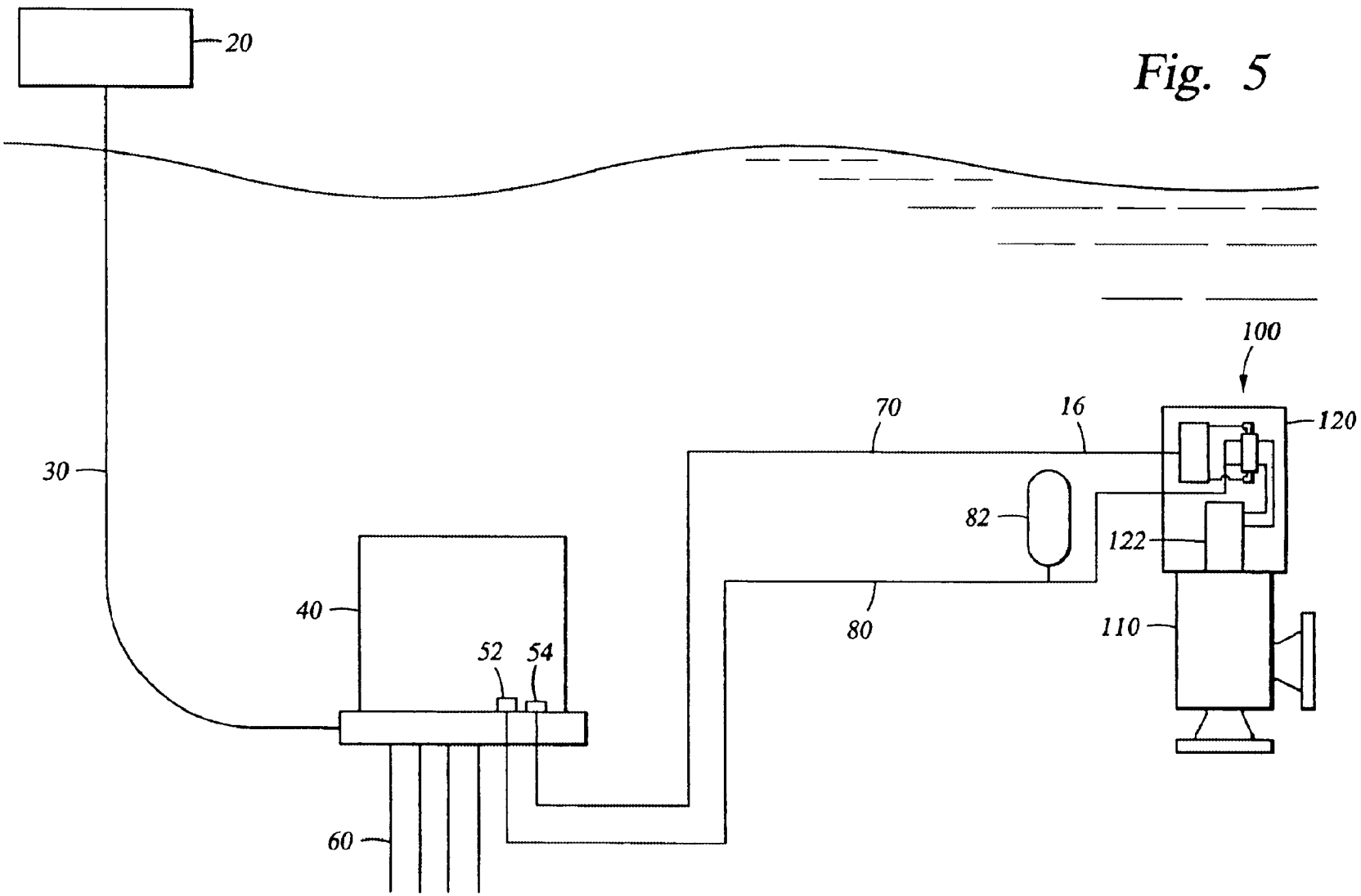
FIG. 5 is a schematic view of one embodiment of a subsea choke system including the choke control system of FIG. 4.

Referring now to FIG. 5, choke 100 is shown remotely controlled from a surface control system 20 via an umbilical 30. Umbilical 30 connects, and serves as the communication link between, a subsea control module 40 and the surface control system 20. Umbilical 30 preferably includes both conductors for relaying control signals (in digital, analog, optical, or current form), such as via wires or fiber optic cables, and one or more conduits providing a supply of hydraulic fluid to the control module 40.

Umbilical 30 connects to module junction plate 50 which serves as the primary interface between the subsea control module 40 and the hydraulic actuators in the subsea trees, valves, and other functions via hydraulic lines 60. Umbilical 30 could attach to a umbilical termination assembly and/or subsea distribution system, with separate or combined hydraulic and electrical flying leads connecting from the subsea distribution system to the subsea control module. In its preferred embodiments, module junction plate 50 provides an interface onto which module 40 can be coupled and de-coupled while the hydraulic plumbing 60 to the subsea functions remains intact. This allows the module 40 to be retrieved to the surface for maintenance and replacement as necessary without disturbing the subsea equipment.

In a conventional multiplexed operation, module 40 includes a plurality of electronic control valves that are actuated by signals sent from the surface control system 20. These signals may be sent directly on electrical conductors in umbilical 30 or converted into optical signals and transmitted along fiber optic lines in umbilical 30. The fiber optic signals are then decoded by electronic equipment integrated into the module 40 and converted into electrical signals to actuate the control valves. Once actuated, the electronic control valves open or close specific hydraulic pathways 60 accessing certain subsea functions. Module 40 receives the supply of hydraulic fluid from umbilical 30 and, in certain embodiments, provides a reservoir of pressurized hydraulic fluid for use in actuating subsea functions.

For example, if an operator wanted to close a particular subsea valve, signals would be sent from the surface control system 20, along umbilical 30, through a subsea distribution system, and be received by subsea control module 40. The signals received by subsea module 40 would actuate a directional control valve, which opens to allow pressurized hydraulic fluid to flow through line 60 into a hydraulic actuator, closing the desired valve. Hydraulic fluid, which has been pumped from the surface and possibly stored in proximate accumulators, either directly supplies the hydraulic pressure and volume for actuation or is used to replenish a subsea supply of fluid used in actuating the valve.

In the preferred embodiments, module junction plate 50 includes connections 52 and 54 for subsea rigid or flying leads for signals 70 and hydraulic supply 80 to supply choke system 100. The hydraulic supply lead 80 preferably feeds a pressurized hydraulic reservoir (e.g., proximate accumulator) 82, which provides a source of constant pressure hydraulic fluid. The signals and hydraulic supplies are routed through module 40, with control valves or switches in module 40 providing on/off supply of hydraulic supply and electrical power for connections 52 and 54. Communication along signal lead 70, utilizing electrical or optical communication signals, may provide two-way communication with choke control system 120 for relaying data concerning position, flow rate, flow constituents, et cetera back to surface control system 20.

Figure 6:
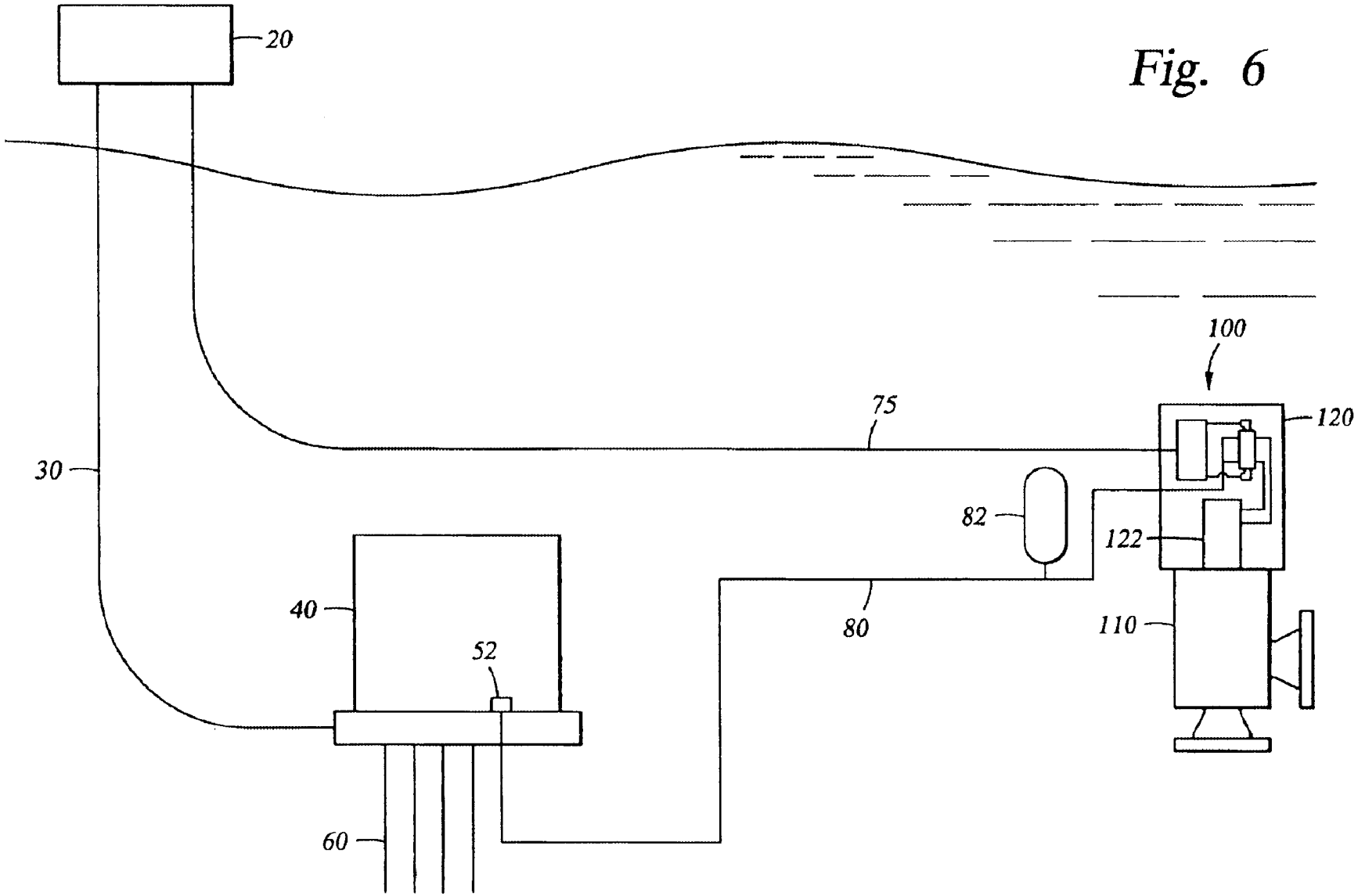
FIG. 6 is a schematic view of an alternative embodiment of a subsea choke system including the choke control system of FIG. 4.

For the subsea case, the signal 70 and hydraulic 80 flying leads can connect directly from a local subsea control module 40 or module mounting base 50, as shown in FIG. 5, or a dedicated signal lead cable 75 can be provided and terminate at a fixed stabplate or junction box on the choke control system 120, as shown in FIG. 6. For the fixed stabplate case, the signal lead cable 75 is preferably equipped with either wet-mateable or dry-mateable connector(s) into which the cable terminates. This system operates substantially the same as the system described in reference to FIG. 5 but provides direct signals communication between the surface control system 20 and the subsea choke 100. Hydraulic supply could also be provided directly to the subsea choke 100 by a hydraulic line bypassing module 40. In other words, a system could be provided where an umbilical carrying signals and hydraulic supply can be connected directly between the surface control system and the subsea choke.

Whether using the single umbilical system of FIG. 5 or the direct umbilical system of FIG. 6, it may be preferred that the hydraulic supply 80 actually include multiple hydraulic supply lines. For systems with more than one hydraulic supply line for operating the chokes, several options are available. One option is to run multiple hydraulic supply lines from the junction plate 50 with shuttle valves (or other manifolding arrangement enabling selection of the hydraulic supply) joining the hydraulic supply lines internally within the choke control system 120. A second option is to mount individual shuttle valves on the hydraulic supplies at or near the junction plate 50 with a single hydraulic line supplying the choke control system 120. This ensures the supply with the highest pressure is provided to the choke control system through a single control line. Alternatively, the hydraulic supplies can be routed through the subsea control module with the control module enabling hydraulic supply selection to the choke. Other similar arrangements for hydraulic supply could be possible, including a closed loop hydraulic system. Application of the system can be similar for an all electric, or direct electric, control system, with reference to hydraulic supplies and selection changed to electric supplies.

Regardless of the system used for communicating between the surface and the subsea choke, the integration of the choke control system 120 and the choke actuator 122 allows the time required to provide a pressure pulse to the actuator to be reduced from about one second to about one-tenth of a second, providing hydraulic fluid is stored local to the choke, such as in reservoir 82 (e.g., proximate accumulators). Although time is still required for allowing the actuator to return to its initial position, the overall actuation of the choke can be greatly accelerated in comparison to previous systems, especially for direct hydraulic systems. The performance of the system is no longer a function of the subsea control module valves or the length and sizing of the connecting tubing and hydraulic couplers between the control module and the choke actuator. These embodiments also eliminate the requirement for choke control valves mounted within the control module, potentially saving space and weight and/or providing spare/extra functions for other controls as well as increasing the mean time between failures (MTBF) of the control module since less components are in the module and the choke control valves are high cycle components.

Figure 7:
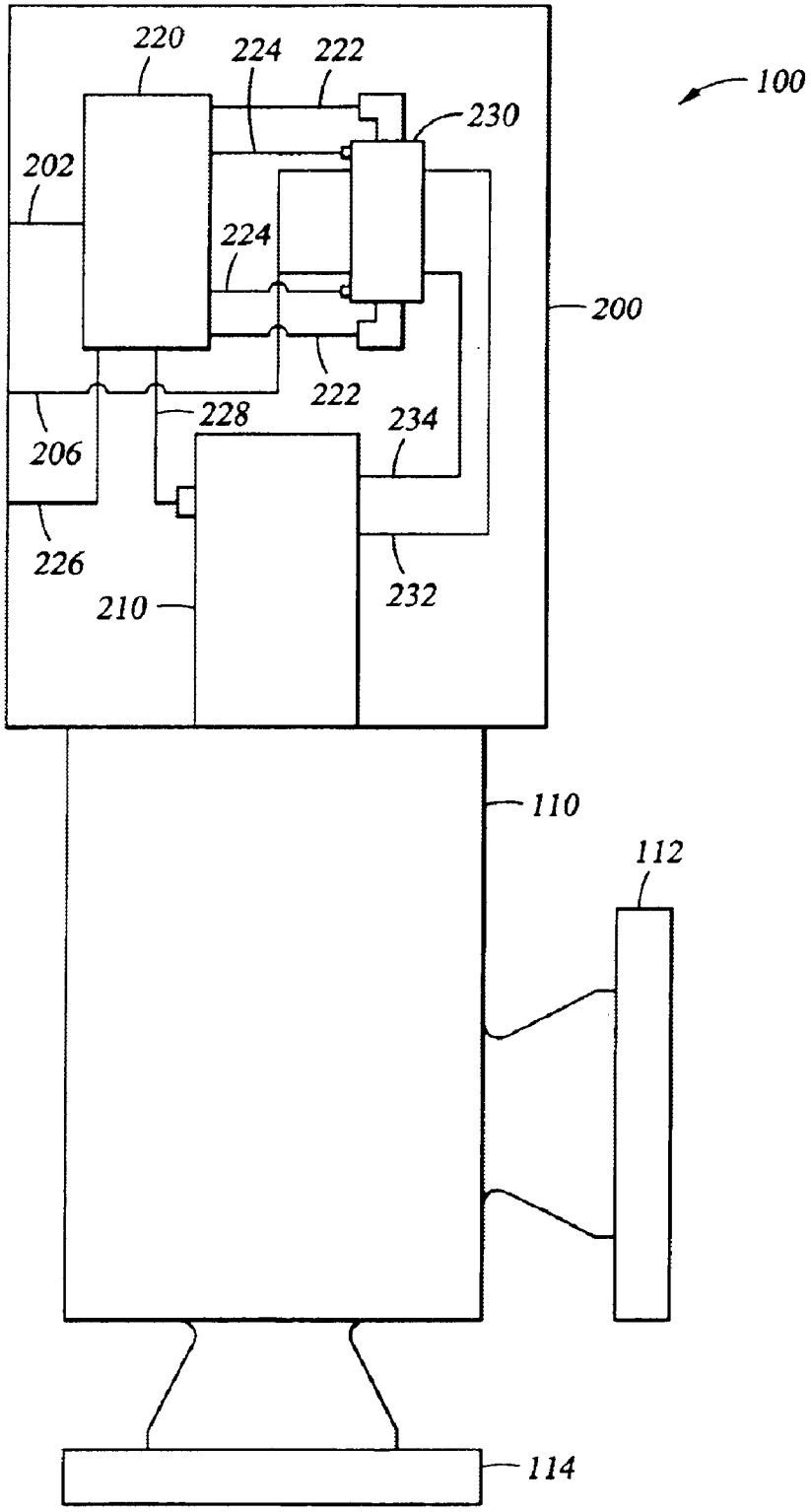
FIG. 7 is a schematic view of an alternative choke control system with integral electronics.

Referring now to FIG. 7, an alternative choke control system 200 is shown. Control system 200 includes a choke actuator 210, a valve electronic module 220, and a directional control valve 230 operating in substantially the same method as described in relation to choke control system 120. The valve electronic module 220 receives signals from a surface control system via signal input 202. In response to the signals received, the valve electronic module 220 transmits signals through electrical connections 222 to the solenoid valves of directional control valve 230.

A supply of hydraulic fluid is provided to the directional control valve 230 along hydraulic input 206. The actuation of the solenoid valves opens hydraulic pathways that allow a hydraulic signal to travel from the directional control valve 203 along hydraulic conduit 232 or 234 to the choke actuator 210. The choke actuator 210 is preferably a hydraulic stepping actuator, of the type commonly used in choke actuation, which converts the linear motion from hydraulic actuation into rotational motion to open or close the choke insert. Other types of chokes and choke actuators, such as linear actuating chokes, fast close/open modules, ROV override, et cetera could be controlled similarly. Hydraulic conduits 232 and 234 provide hydraulic fluid to either an open or close spring-return hydraulic cylinder. These cylinders move linearly in response to hydraulic pressure and then return to their initial positions using a biasing spring. Thus, each pressure pulse from the directional control valve 230 rotates the choke actuator a certain increment causing linear adjustment of the choke insert.

Choke control system 200 also provides additional functionality in having dual pressure sensors 224 providing feedback to the valve electronic module 220 that pressure has been applied to the proper stepping piston (i.e. the solenoid valve has actuated). The choke control system 200 can also incorporate a position indication device 228 (LVDT or similar) that provides feedback as to the actual position of the choke insert and confirms that the choke actuator moves in response to control inputs. Some embodiments may also have an auxiliary instrumentation input 226 that collects data from various other sensors for analysis by either the choke or surface the control systems.

For example, pressure and/or temperature sensors could be located on the choke inlet and outlet to measure flow conditions at these points. This data could then be transmitted back to the surface to give the operators an indication of flow conditions at the choke and evaluate the performance of the choke. The system may further provide capability to yield early warning of hydrate formation and/or of choke insert failure. With a first sensor positioned upstream of the choke and a second sensor positioned downstream of the choke, and incorporating system and sensor data from previous geometry change(s) and pressure and temperature sensors, system diagnostics and analytical determination of system flow characteristics, including the determination of multiphase, flow characteristics and percentages, could be possible. The analysis and processing the information acquired by these sensors and transmitted along line 226 could be performed locally by the choke control system 200 at the subsea control module, or at the surface with the data transmitted along the electrical leads. The choke control system may also incorporate a hydraulic fluid filter (not shown) mounted internal or external to the choke control system on the hydraulic supply line 80.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A control system comprising:

an actuator adapted to adjust the position of an adjustable component in response to hydraulic signals;

a directional control valve to supply hydraulic signals from a hydraulic supply to said actuator in response to electrical signals; and a valve electronic module adapted to receive input signals from a remotely located control system and transmit control signals to said directional control valve, wherein said actuator, said directional control valve, and said valve electronic module are integrated into a single package.

2. The system of claim 1 further comprising a pressure sensor adapted to measure the hydraulic pressure in said directional control valve and transmit the pressure data to said valve electronic module.

3. The system of claim 1 further comprising a position sensor adapted to measure the position of said actuator and transmit the position data to said valve electronic module.

4. The system of claim 1 wherein the adjustable component is a choke and the system further comprises a plurality of sensors adapted to measure flow characteristics upstream and downstream of the choke and transmit the flow characteristic data to said valve electronic module.

5. The system of claim 1 wherein the integrated single package is releasably connected to the adjustable component and is retrievable to the surface independently of the adjustable component.

6. The system of claim 1 wherein the input signals and the hydraulic supply are received from a subsea control module connected to the remotely located control system via an umbilical.

7. The system of claim 1 wherein the input signals are received directly from the remotely located control system along a cable.

8. A subsea choke system comprising:

a surface control system;

a subsea choke;

a choke control system; and means for providing communication signals between said surface control system and said choke control system, wherein said choke control system comprises a valve electronic module, directional control valve, and actuator integrated into a single package so as to actuate said subsea choke in response to signals received from said surface control system.

9. The system of claim 8 wherein said means for providing communication signals includes a cable run between said choke control system and a subsea control module.

10. The system of claim 8 wherein said means for providing communication signals includes a cable run between said choke control system and said surface control system.

11. The system of claim 8 further comprising means for providing a hydraulic supply to said choke control system.

12. The system of claim 9 wherein said choke control system further comprises:

a hydraulically operated choke actuator;

a directional control valve adapted to control the flow of hydraulic fluid to said choke actuator; and a valve electronic module adapted to actuate said directional control valve in response to signals received from said surface control system.

13. The system of claim 12 wherein said choke control system further comprises a pressure sensor adapted to measure the hydraulic pressure in said directional control valve and transmit the pressure data to said valve electronic module.

14. The system of claim 12 wherein said choke control system further comprises a position sensor adapted to measure the position of said choke actuator and transmit the position data to said valve electronic module.

15. The system of claim 8 wherein said choke control system further comprises a plurality of sensors adapted to measure flow characteristics upstream and downstream of said subsea choke and transmit the flow characteristic data to said valve electronic module.

16. The system of claim 8 wherein said choke control system is releasably connected to said subsea choke and is retrievable to the surface independently of said subsea choke.

17. A method for controlling a choke comprising:

transmitting signals from a remotely located control system to a valve electronic module integrated into a choke control system;

providing a hydraulic supply to a directional control valve integrated into the choke control system;

converting the signals into control signals in the valve electronic module;

transmitting control signals from the valve electronic module to open the directional control valve to allow hydraulic fluid to flow to a choke actuator integrated into the choke control system.

18. The method of claim 17 wherein the digital signals and hydraulic supply are carried to the choke control system through a subsea control module.

19. The method of claim 17 wherein the signals are transmitted directly between the remotely located control system and the choke control system.

20. The method of claim 17 further comprising:

measuring the hydraulic pressure within the directional control valve; and transmitting the pressure data to the valve electronic module in order to monitor operation of the directional control valve.

21. The method of claim 17 further comprising:

measuring the position of the choke actuator; and transmitting the position data to the valve electronic module in order to monitor actuation of the choke.

22. The method of claim 17 further comprising:

measuring flow characteristics upstream and downstream of the choke; and transmitting the flow characteristic data to the valve electronic module in order to monitor flow conditions and choke operation.

* * * * *

UNITED STATES PATENT AND TRADEMARK OFFICE
Certificate

Patent No. 6,988,554 B2 Patented: January 24, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John Eric Bodine, Houston, TX (US); David Anthony James, Houston, TX (US); Declan Elliott, Lamagh, Ireland; and Edmund McHugh, Longford Town, Ireland.

Signed and Sealed this Twenty-fifth Day of July 2006.

DAVID BAGNELL
*Supervisory Patent Examiner*
Art Unit 3672